United States Patent [19]

Lee et al.

[11] Patent Number: 4,676,860

[45] Date of Patent: Jun. 30, 1987

[54] MACHINE FOR FORMING OPEN ENDED CARTONS

[75] Inventors: Richard G. Lee, Boston; Robert T. Fletcher, Billerica, both of Mass.

[73] Assignee: Econocorp, Inc., Randolph, Mass.

[21] Appl. No.: 822,149

[22] Filed: Jan. 24, 1986

[51] Int. Cl.[4] ..... B31F 1/00

[52] U.S. Cl. ..... 156/443; 156/217; 156/227; 493/151; 493/177; 493/178; 493/183

[58] Field of Search ..... 156/217, 227, 443; 493/151, 177, 178, 183

[56] References Cited

U.S. PATENT DOCUMENTS

| | | | |
|---|---|---|---|
| 3,964,374 | 6/1976 | Stolkin et al. | 493/151 X |
| 4,563,169 | 1/1986 | Virta et al. | 493/151 X |
| 4,582,552 | 4/1986 | Fitzgibbon et al. | 156/443 X |

*Primary Examiner*—Robert A. Dawson

*Attorney, Agent, or Firm*—Maurice E. Gauthier

[57] ABSTRACT

A machine for forming open ended cartons from flat die cut blanks of flexible material. The machine includes a magazine adapted to contain a supply of the blanks, and first, second and third forming stations through which the blanks are successively shifted by automatically operable transfer mechanisms. The blanks are progressively folded as they progress through the forming stations. At a final stage in the forming process, adhesive is selectively applied to the undersides of exposed side flaps, and these side flaps are then folded to produce the desired end product. At various stages during the forming process, the partially erected blanks are supported both internally and externally in order to avoid deformation or collapsing of open ends, and to insure precise bending along fold lines.

12 Claims, 12 Drawing Figures

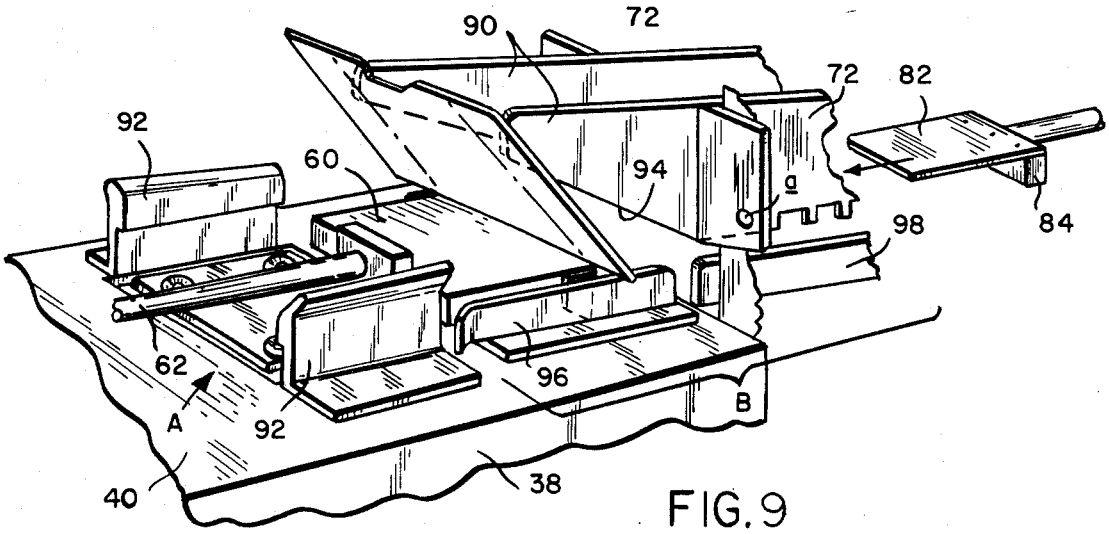
FIG. 9
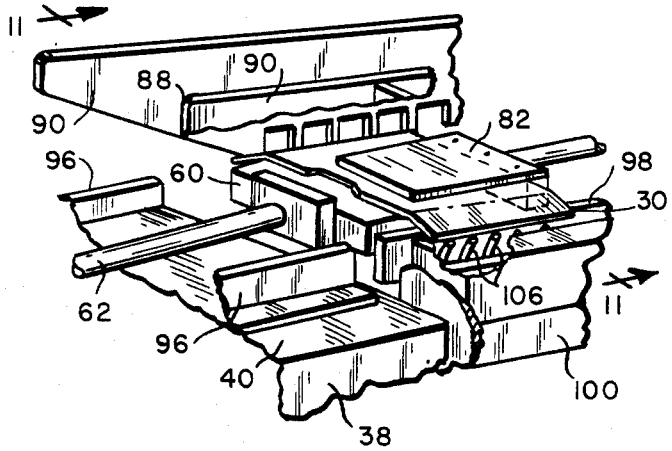
FIG. 10
FIG. 12
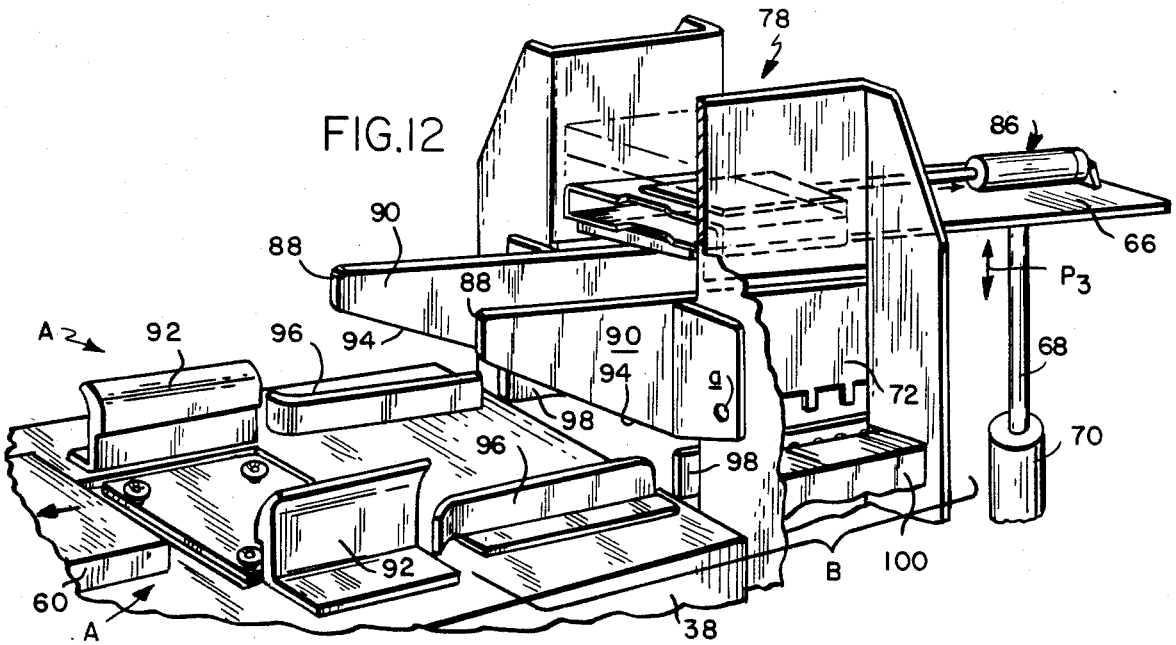

MACHINE FOR FORMING OPEN ENDED CARTONS

FIELD OF THE INVENTION

This invention relates generally to a machine for forming open ended cartons from flat die cut blanks of flexible material, typically cardboard or the like. Such cartons are difficult to erect, primarily because their open ends are not self supporting and are thus prone to being collapsed or distorted during the erection process. This problem becomes even more acute when the blank material is relatively thin and pliable, as is often the case with low cost cartons of the type typically employed in the packaging of relatively inexpensive consumer products, e.g., video cassettes and the like.

SUMMARY OF THE INVENTION

The machine of the present invention is adapted to operate on a flat or planar die cut blank having upper and lower panels respectively joined to a bottom panel along first and second fold lines. The lower, bottom and upper panels each have side flaps respectively joined thereto along third, fourth and fifth fold lines.

The machine includes a magazine adapted to contain a supply of the planar blanks, and first, second and third forming stations through which the blanks are successively shifted by automatically operable transfer mechanisms. As the blanks progress through the forming stations, their panels and side flaps are progressively folded. At a final stage in the erection process, adhesive is selectively and sparingly applied to the undersides of exposed side flaps, and these side flaps are then folded to produce the desired end product. At critical stages during the erection process, the partially erected blanks are supported both internally and externally in order to avoid deformation or collapsing of open ends, and to insure precise bending along the fold lines.

The finished carton is structurally self supporting and ready to accept product through its open end. Adhesive application is kept to an abolute minimum and is confined exclusively to unexposed carton surfaces.

Preferably, in order to maximize compactness of the machine, the blanks progress from a first magazine along a generally U-shaped path, with the various forming stations being located along said path, and with the fully erected cartons ultimately arriving at a second magazine located directly adjacent to the first magazine.

BRIEF DESCRIPTION OF THE DRAWINGS

FIG. 9 is another perspective view showing the second transfer means being advanced to shift a blank from the first forming station to the second forming station;

FIG. 10 is a perspective view showing the blank at the second forming station with the upper panel holding means in its advanced operative position;

FIG. 12 is another perspective view showing a finished carton elevated to a second magazine overlying the third forming station.

DESCRIPTION OF ILLUSTRATED EMBODIMENT

Figure 1:
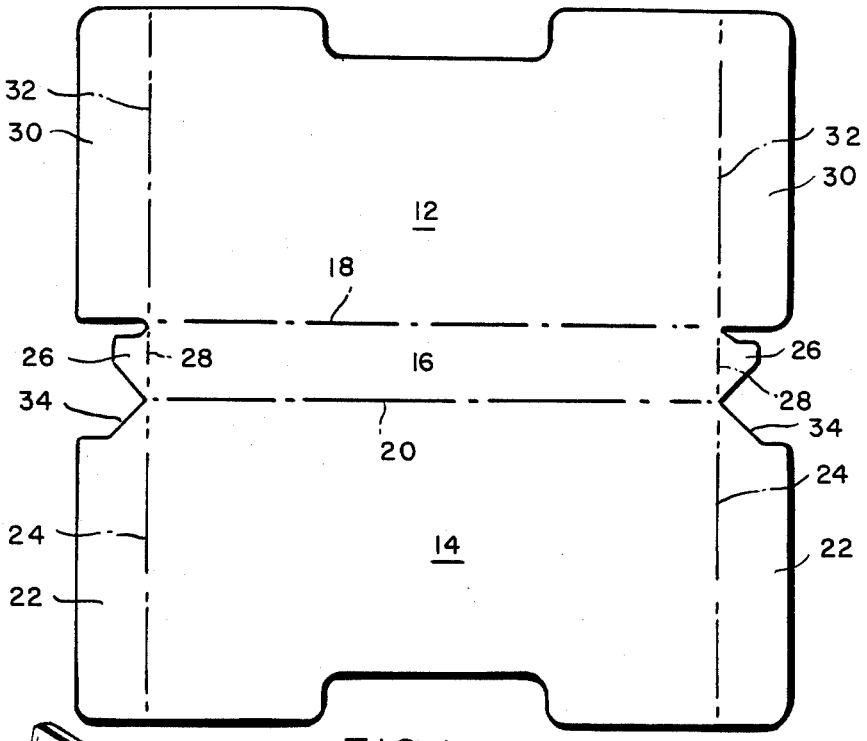
FIG. 1 is a plan view showing the interior side of a typical planar blank.

Referring initially to FIG. 1, there is illustrated a typical blank 10 on which the machine of the present invention is intended to operate. The blank has upper and lower panels 12, 14 respectively joined to a bottom panel 16 along first and second fold lines 18, 20. The lower panel 14 has side flaps 22 joined thereto along third fold lines 24 perpendicular to the second fold line 20. Similarly, the bottom panel 16 has side flaps 26 joined thereto along fourth fold lines 28 perpendicular to the fold lines 18,20. The upper panel 12 has side flaps 30 joined thereto along fifth fold lines 32 perpendicular to the fold line 18. Notches 34 are provided at the inner ends of the lower panel side flaps 22.

Figure 5:
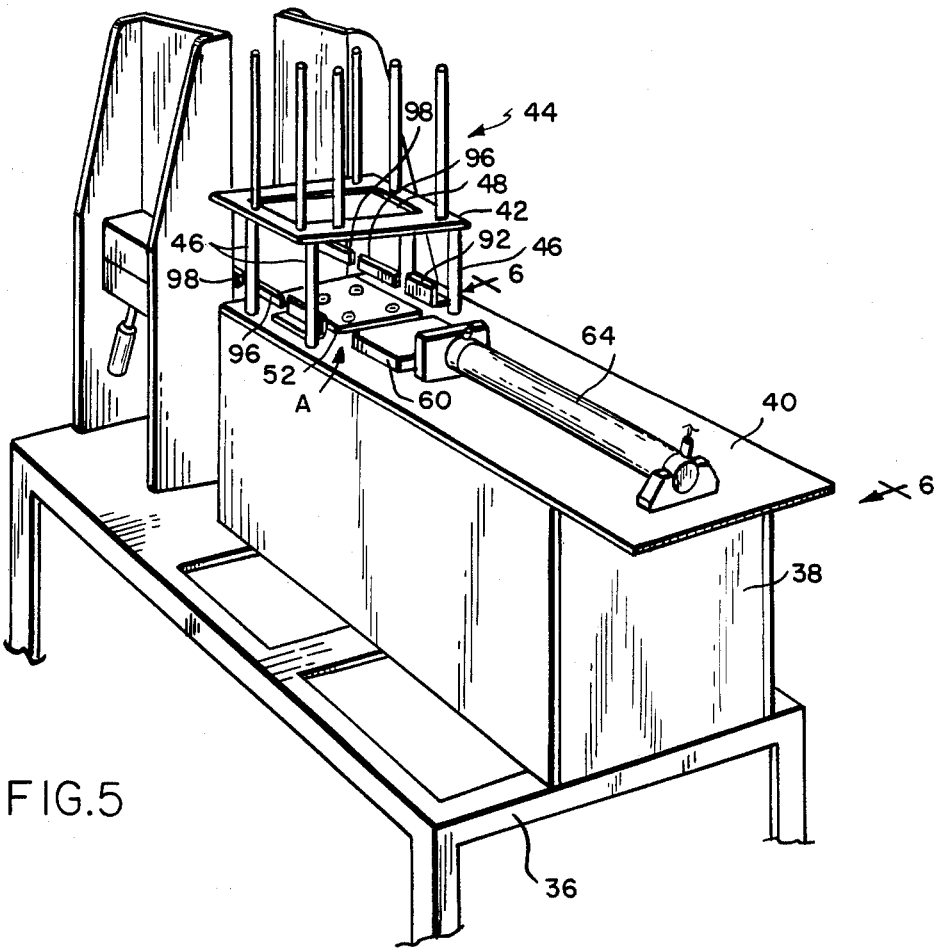
FIG. 5 is a perspective view of a machine in accordance with the present invention.
Figure 6:
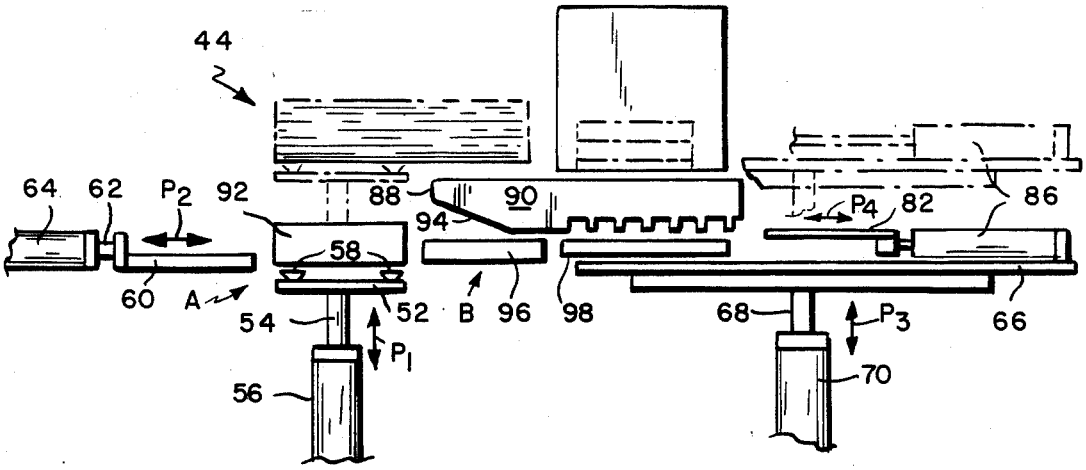
FIG. 6 is a somewhat schematic side elevational view of the machine, looking in the direction indicated by line 6—6 in FIG. 5, with much of the frame structure either omitted or abbreviated in the interest of clarity.
Figure 7:
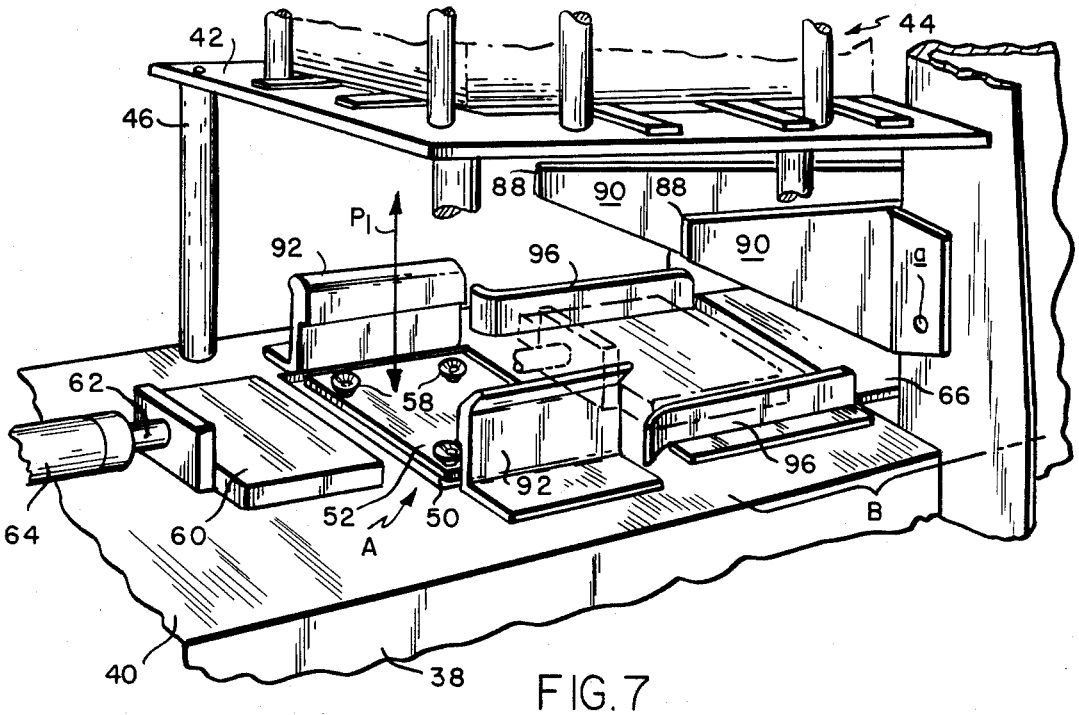
FIG. 7 is a perspective view of the first forming station with the first transfer means fully retracted.
Figure 8:
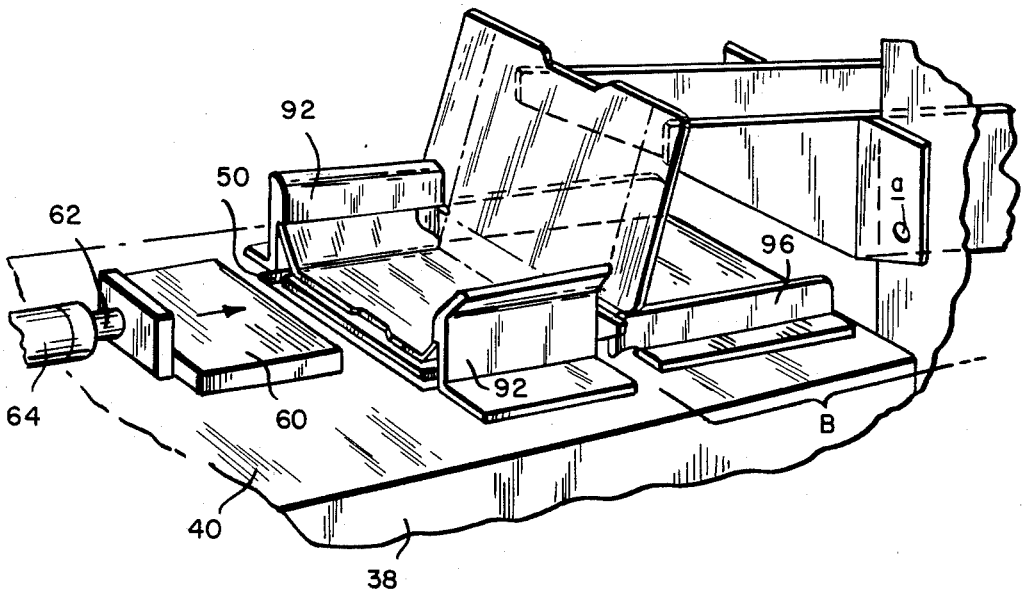
FIG. 8 is a view similar to FIG. 7 after the first transfer means has been cycled to lower a blank from the first magazine to the first forming station.

Basic features of the machine are illustrated in FIGS. 5–7. The machine includes a base frame 36 supporting a housing 38 having a top surface 40. The bottom plate 42 of a first magazine 44 is supported on legs 46 at a location overlying a first forming station generally indicated at "A". The bottom plate 42 has a rectangular opening 48 vertically aligned with a similar opening 50 in the top housing surface 40.

A first transfer means comprises a plate 52 carried on the piston rod 54 of a cylinder 56. The cylinder 56 is located in the housing 38, and the plate 52 has suction cups 58 on its upper surface which are connected in a known fashion by flexible conduits (not shown) to a vacuum source. The cylinder 56 operates to vertically reciprocate the plate 52 along a first path $P_1$ between a lowered position located in the opening 50 at a level flush with the top housing surface 40, and a raised position indicated by the broken lines in FIG. 6.

A second transfer means comprises a rectangular block-shaped insert 60 attached to the piston rod 62 of another cylinder 64. The cylinder 64 is supported horizontally on the top housing surface 40, and it operates to horizontally reciprocate the insert 60 along a second path $P_2$ between a retracted position as shown by the solid lines in FIGS. 5–7, and an advanced position at a second forming station "B", as indicated by the broken lines in FIG. 7. The second forming station B is located laterally from and at the same level as the first forming station A.

A third transfer means comprises an elevator platform 66 mounted on the piston rod 68 of a cylinder 70. The cylinder 70 operates to vertically reciprocate the platform 66 along a third path $P_3$ between a retracted position at which a portion of the platform underlies the second forming station B as shown by the solid lines in FIG. 6, and a raised position indicated by the broken lines in the same illustration at which the same portion of the platform is located above a third forming station "C", the latter being located above the second forming station B. The first and third transfer means thus operate along parallel first and third paths $P_1$, $P_3$.

Figure 11:
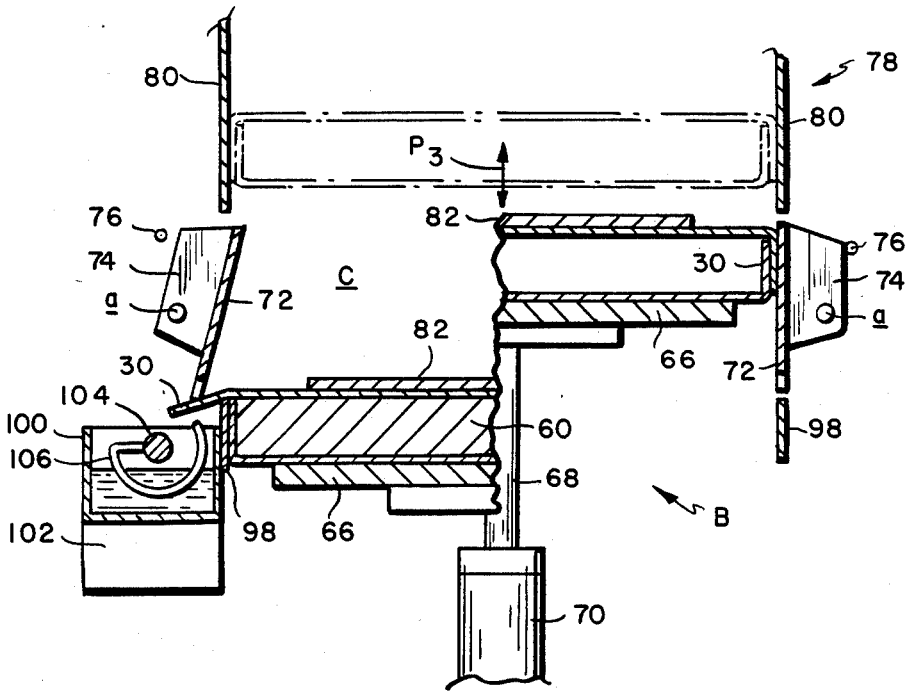
FIG. 11 is a split sectional view on an enlarged scale taken along line 11—11 of FIG. 10 and showing details of the third forming station.

As can be best seen in FIG. 11, the third forming station C includes third guide surfaces constituted by side walls 72 with laterally extending brackets 74. The side walls 72 are pivotable about axes "a" between laterally outwardly inclined positions (left-hand side of FIG. 11) and vertical positions at which their brackets 74 abut fixed stops 76 (right-hand side of FIG. 11).

A second carton magazine 78 overlies the third forming station C. The carton magazine includes parallel side walls 80 with which the side walls 72 of the third forming station C are in vertical alignment when the wall brackets 74 are pivoted into engagement with the stops 76.

The platform 66 of the third transfer means carries a holding means constituted by a flat hold down plate 82 traversed by an underlying stop shoulder 84. The stop shoulder is connected to the piston rod of a cylinder 86 which operates to reciprocate the plate 82 and its stop shoulder 84 along a path indicated at $P_4$ in FIG. 6.

The operation of the machine will now be described with reference to the remaining illustrations.

First Erection Stage

Figure 2:
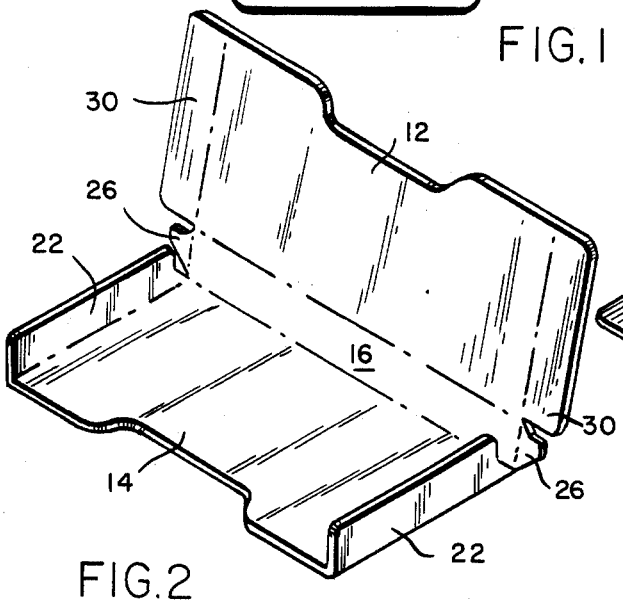
FIGS. 2, 3 and 4 are perspective views of the blank at various stages during the erection process.

The first erection stage begins with the cylinder 56 being actuated to elevate the plate 52 to the position indicated by the broken lines in FIG. 6. Vacuum is then applied to the suction cups 58, causing them to grip the lowermost blank in the first magazine 44. The cylinder 56 is then operated to retract the plate 52, causing the lowermost blank to be removed from the magazine 44 through the opening 48 in plate 42. As the blank is shifted downwardly along path $P_1$, it encounters first stationary guide surfaces constituted by shoulders 88 on the side walls 72, and by two confronting stationary walls 92 extending upwardly from the housing top surface 40. The shoulders 88 coact with the downwardly moving plate 52 carrying the blank to bend the blank along its second fold line 20, thereby causing the combination of the bottom and upper panels 16, 12 and their respective side flaps 26, 30 to be bent upwardly with respect to the lower panel 14. In a similar fashion, the walls 92 also coact with the downwardly moving plate 52 to bend the lower panel side flaps 22 upwardly. At the end of the downward stroke of the plate 52, which terminates the first erection stage, the blank is in the condition depicted in FIG. 2. Vacuum is now released from the suction cups 58, thereby freeing the blank for movement out of the first forming station A.

Second Erection Stage

Figure 3:
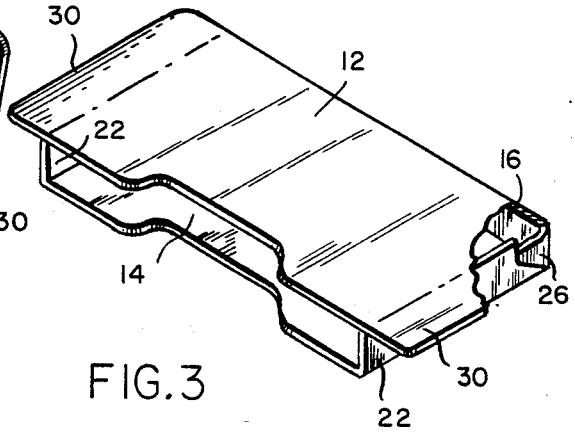

The cylinder 64 is now actuated to advance the insert 60 across the first forming station A to the second forming station B, carrying the blank along with it. As the blank moves towards the second forming station, as shown in FIG. 9, it encounters second guide surfaces constituted by lower edges 94 on the side walls 72, and by parallel confronting walls 96, 98 extending along the sides of the second forming station. The wall 96 coacts with the advancing insert to fold the bottom panel side flaps 26 inwardly along the fourth fold lines 28 into the recesses 34 of the lower panel side flaps 22 and into a substantially coplanar relationship therewith. In a similar manner, the lower side wall edges 94 coact with the advancing insert 60 to fold the blank along its first fold line 18, thereby causing the upper panel 12 to be folded into an overlying relationship with respect to the lower panel 14, with the upper panel side flaps 30 extending laterally beyond the side flaps 22, 26 of the lower and bottom panels 14, 16. The holding means is then actuated to advance the hold down plate 82 to a position overlying and in contact with the upper panel 12 of the blank. At the same time the shoulder stop 84 contacts the bottom panel 16 of the blank, forcing it into a vertical disposition perpendicular to the upper and lower panels 12, 14. The upper panel is firmly gripped and held horizontally between the hold down plate 82 and the top surface of the insert 60, and the lower panel is likewise gripped and held horizontally between the bottom surface of the insert and the platform 66. The side flaps 22, 26 are held between the side surfaces of the insert 60 and the walls 98. Thus, except for the side flaps 30 of the upper panel 12, all bends have now been completed, and the blank is in the condition shown in FIG. 3.

Application of Adhesive

Adhesive is now applied to the exposed undersides of the upper panel side flaps 30. The adhesive is maintained in a liquid state in reservoirs 100 located exteriorly of the walls 98 along the sides of the second forming station B. Heaters 102 underlie the reservoirs 100, and rotatable shafts 104 carrying curved fingers 106 are employed to apply adhesive to the undersides of the side flaps 30. With reference to the left-hand side of FIG. 11, it will be understood that during the adhesive application cycle, the shafts 104 are partially rotated in one direction to submerge the finger tips in the liquid adhesive, and then are rotated in the opposite direction to bring the coated fingers tips into contact with the undersides of the side flaps 30. As adhesive is being applied to the side flaps 30, the insert 60 is being retracted.

Third and Final Erection Stage

Figure 4:
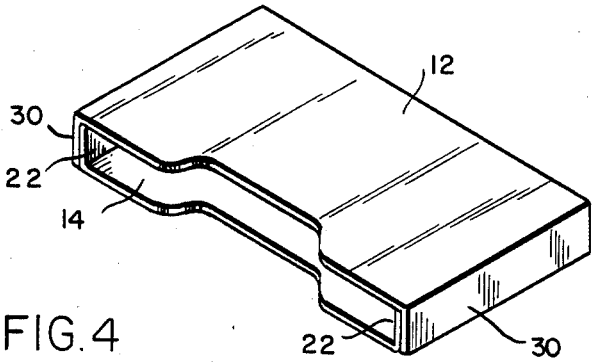

After applying adhesive to the undersides of the upper panel side flaps 30, and with the insert 60 retracted from the second forming station B, the cylinder 70 is then actuated to elevate the blank through the third forming station C into the second magazine 78. As the blank moves upwardly into the third forming station, the pivotal side walls 72 gradually bend the adhesively coated flaps 30 inwardly about the fifth fold lines 32 until the flaps 30 cover and are adhered to the previously bent side flaps 22, 26 of the lower and bottom panels 14, 16. As the blank rises above the plane of the side wall pivot axes "a", the wall brackets 74 encounter the stops 76 (see right-hand side of FIG. 11), thereby insuring that the side walls 72 are aligned with the walls 80 of the second magazine 78. Thus, the blank, now fully formed as a completed carton, continues upwardly into the carton magazine 78. The condition of a fully formed carton is illustrated in FIG. 4. As soon as a completed carton rises above the pivotal side walls 72, these walls return to the inclined positions shown at the left-hand side of FIG. 11, thereby acting as stops which prevent completed cartons from falling out of the second magazine 78. Cylinder 86 is then actuated to retract the holddown plate 82, after which cylinder 70 is actuated to return the platform 66 to its lowered position.

It thus will be seen that the blank has an interior side which defines the internal surfaces of the finished carton, and an exterior side which defines the external surfaces of the carton. The various machine guide surfaces are arranged to contact the external blank surfaces, whereas the insert 60 contacts the interior blank surfaces and provides important internal support during the various bending operations. The multi-sided insert has edges about which the blank is bent along its fold lines.

Preferably, in order to maximize efficiency, portions of the first and third erection stages will overlap each other. For example, once the insert 60 has been retracted to its inoperative position, the first transfer means may be cycled to begin processing another blank through the first erection stage while the previous blank continues to be processed through the third and final erection stage.

Machine compactness is enhanced by locating the successive forming stations along a generally U-shaped path schematically illustrated by the dot-dash line "X" in FIG. 6. Both magazines 44,78 are thus arranged in a side-by-side relationship and are easily accessible by operators when loading blanks into the machine and when extracting completed cartons therefrom.

In light of the foregoing, it will now be appreciated by those skilled in the art that modifications may be made to the disclosed embodiment without departing from the spirit and scope of the invention as defined by the claims appended thereto. For example, while the insert 60 has been depicted as a solid block, other forms are possible, including wire-like frames designed to delineate some or all of the carton fold lines. Instead of an insert, the actual product, i.e., a video cassette, might be substituted and allowed to remain in place in the finished carton.

We claim:

1. Apparatus for forming a planar blank into an open ended carton, said planar blank having upper and lower panels respectively joined to a bottom panel along first and second fold lines, said lower panel having lower panel side flaps joined thereto along third fold lines perpendicular to said second fold line, said bottom panel having bottom panel side flaps joined thereto along fourth fold lines perpendicular to said first and second fold lines, said upper panel having upper panel side flaps joined thereto along fifth fold lines perpendicular to said first fold line, said apparatus comprising:

first, second and third forming stations, each station being respectively defined at least in part by first, second and third guide surfaces;

a magazine adapted to contain a plurality of said planar blanks;

first transfer means for removing a planar blank from said magazine to said first forming station, said first guide surfaces being arranged to coact with said first transfer means in bending said blank along said second and third fold lines, thereby causing said lower panel side flaps and the combination of said bottom and upper panels to extend upwardly with respect to said lower panel;

second transfer means for shifting each blank from said first forming station to said second forming station, said second guide surfaces being arranged to coact with said second transfer means in bending said blank along said first and fourth fold lines, thereby causing said bottom panel side flaps to be arranged in substantially coplanar relationship with said lower panel side flaps, and causing said upper panel to be arranged in an overlying relationship with respect to said lower panel, with said upper panel side flaps extending laterally beyond the side flaps of said lower and bottom panels;

means for applying an adhesive to the undersides of said upper panel side flaps; and third transfer means for shifting each blank from said second forming station to said third forming station, said third guide surfaces being arranged to coact with said second transfer means in bending said blanks along said fifth fold lines, thereby causing said upper panel side flaps to overlap and adhere to the side flaps of said lower and bottom panels.

2. The apparatus of claim 1 wherein said first forming station underlies said magazine, and wherein said first transfer means shifts planar blanks individually from said magazine along a vertical first path to said first forming station.

3. The apparatus of claim 2 wherein said second forming station is disposed laterally with respect to said first forming station, and wherein said second transfer means shifts blanks from said first forming station to said second forming station along a horizontal second path.

4. The apparatus of claim 3 wherein said third forming station overlies said second forming station, and wherein said third transfer means shifts blanks from said second forming station to said third forming station along a third vertical path.

5. The apparatus of claim 4 wherein said first and third paths are arranged in parallel relationship.

6. The apparatus of claim 1 wherein an interior side of said blank defines the internal surfaces of said carton and an exterior side of said blank defines the external surfaces of said carton, and wherein said guide surfaces are arranged to contact said external surfaces.

7. The apparatus of claim 6 herein said first transfer means includes an insert for contacting and supporting the internal surfaces of said blank.

8. The apparatus of claim 7 wherein said insert includes edges about which said blank is bent along said fold lines.

9. The apparatus of claim 7 wherein said first transfer means operates to remove said insert from said blank prior to said blank being shifted from said second forming station to said third forming station.

10. The apparatus of claim 9 wherein said third transfer means further comprises holding means for overlying and retaining said upper panel in parallel relationship with said lower panel during shifting of said blank from said second forming station to said third forming station.

11. The apparatus of claim 10 wherein said holding means includes stop means arranged to coact with said insert in bending said blank along said second fold line.

12. Apparatus for forming a planar blank into an open ended carton, said planar blank having upper and lower panels respectively joined to a bottom panel along first and second fold lines, said lower panel having lower panel side flaps joined thereto along third fold lines perpendicular to said second fold line, said bottom panel having bottom panel side flaps joined thereto along fourth fold lines perpendicular to said first and second fold lines, said upper panel having upper panel side flaps joined thereto along fifth fold lines, perpendicular to said first fold line, said apparatus comprising:

a first magazine in which a plurality of said planar blanks may be stored for removal individually through a lower opening, a first forming station underlying the lower magazine opening, vertically reciprocative first transfer means for removing the lowermost blank from said magazine through said opening and along a downward first path to said first forming station, first stationary means positioned at said first forming station for engaging and bending said blank along said third fold lines and for causing said lower panel side flaps to extend upwardly with respect to said lower panel, second stationary means positioned in said first downward path between said lower opening and said first forming station for engaging and bending said blank along said second fold line to thereby cause the combination of said bottom and upper panels along with their respective side flaps to extend upwardly with respect to said lower panel, horizontally reciprocative second transfer means for shifting said blank from said first forming station along a second path perpendicular to said first path to a second forming station disposed laterally with respect to said first forming station, second stationary means positioned at said second forming station, said second stationary means acting in concert with said second transfer means to bend said blank along said fourth fold lines, thereby aligning said bottom panel side flaps in substantially coplanar relationship with said lower panel side flaps, third stationary means positioned at said second forming station, said third stationary means acting in concert with said second transfer means to bend said blank along said first fold line, thereby arranging said upper panel in a position overlying said lower panel with said upper panel side flaps extending laterally beyond the side flaps of said lower panel and bottom panel, holder means movable from an inoperative position laterally remote from said second forming station to an operative position overlying said second forming station and in contact with said upper panel, means for applying an adhesive to the undersides of said upper panel side flaps, vertically reciprocative third transfer means for shifting said blank from said second forming station along a third path to a second magazine, and fourth stationary means positioned along said third path, said fourth stationary means acting in concert with said third transfer means to bend said blank along said fifth hold lines and to cause said upper panel side flaps to overlap and adhere to the end flaps of said lower and bottom panels.

* * * * *